US006460796B1

(12) United States Patent
Berning et al.

(10) Patent No.: US 6,460,796 B1
(45) Date of Patent: Oct. 8, 2002

(54) REEL FOR SUPPORTING COMPOSITE COILED TUBING

(75) Inventors: Scott A. Berning; Dick C. Headrick; Clint W. Isennock, all of Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/443,407

(22) Filed: Nov. 19, 1999

(51) Int. Cl.[7] ..... B65H 75/24; B65H 75/38; A62C 35/00

(52) U.S. Cl. ..... 242/407.1; 242/571; 242/577.1; 242/609.4; 242/610.4; 137/355.16

(58) Field of Search ..... 242/407.1, 571, 242/577.1, 601, 609.4, 609, 610.4, 613, 118.2, 118.7, 118.8, 910, 407; 137/355.16

(56) References Cited

U.S. PATENT DOCUMENTS

| | | | | | |
|---|---|---|---|---|---|
| 994,025 | A | * | 5/1911 | Montgomery | 242/577.1 |
| 1,245,491 | A | * | 11/1917 | Montgomery | 242/577.1 |
| 1,368,069 | A | * | 2/1921 | Stokes | 242/118.7 |
| 1,999,606 | A | * | 4/1935 | Grumney et al. | 242/577.1 |
| 2,010,811 | A | * | 8/1935 | Craig | 242/577.1 |
| 2,358,635 | A | * | 9/1944 | Grise | 242/577.1 |
| 2,605,978 | A | * | 8/1952 | Allard | 242/609 |
| 2,777,646 | A | * | 1/1957 | Manahan | 242/577.1 |
| 3,982,402 | A | | 9/1976 | Lang et al. | |
| 4,034,932 | A | * | 7/1977 | Ferch | 242/610.4 |
| 4,657,202 | A | * | 4/1987 | Sauber | 242/577.1 |
| 4,695,008 | A | * | 9/1987 | Dabrowski | 242/610.4 |
| 4,696,438 | A | * | 9/1987 | Myers | 242/118.7 |
| 5,826,608 | A | | 10/1998 | Pierce | |
| 5,839,514 | A | * | 11/1998 | Gipson | 242/399.1 |
| 5,865,392 | A | | 2/1999 | Blount et al. | |
| 5,921,285 | A | | 7/1999 | Quigley et al. | |
| 6,138,940 | A | * | 10/2000 | Hurd | 242/601 |

FOREIGN PATENT DOCUMENTS

| | | | | |
|---|---|---|---|---|
| FR | 2691651 | * | 12/1993 | 242/577.1 |
| WO | WO-90/03328 | * | 4/1990 | 242/571 |

* cited by examiner

*Primary Examiner*—John M. Jillions
(74) *Attorney, Agent, or Firm*—Browning Bushman, P.C.

(57) ABSTRACT

This invention relates to two apparatus and one method for use in spooling composite coiled tubing onto a coiled tubing reel. One apparatus includes the modification of tubing reel cores currently in common use by the direct adhesion of a compliant material to the hub. Another apparatus modifies the commonly used tubing reel hub by affixing several panels concentric to the hub and mounted on compression springs. The method entails the pressurization of the composite coiled tubing prior to spooling onto the tubing reel, and subsequently releasing the pressure within the composite tubing after it has been spooled onto the tubing reel. Both apparatus and the method protect the reel core by absorbing or eliminating the radially inward forces of the composite tubing resulting from the pressurization and corresponding contraction in length of the spooled composite coiled tubing.

21 Claims, 2 Drawing Sheets

REEL FOR SUPPORTING COMPOSITE COILED TUBING

FIELD OF THE INVENTION

This invention relates generally to reels for supporting and transporting coiled tubing and, more specifically, to tubing reel cores and methods for wrapping composite coiled tubing around a tubing reel core.

BACKGROUND OF THE INVENTION

Coiled tubing has been used successfully in the oil and gas industry for many years. The development of new technology has expanded the role of coiled tubing in completion, workover, drilling and production applications. The vast majority of technology and applications have focused on metallic coiled tubing. Although uses for metallic coiled tubulars have significantly increased in the past twenty years, limitations are experienced on occasion with metallic tubulars, including tensile strength limitations due to string weight and corrosion susceptibility from inhospitable conditions.

Technology advancements in non-metallic, composite based coiled tubing products have facilitated solutions to many of the limitations encountered with metallic tubing. Composite tubing is commonly composed of a combined resinous-fibrous outer tube concentrically encompassing a plastic inner tube, with the inner tube substantially providing the desired strength and protective properties. When manufactured, the inner tube commonly becomes integrally fixed to the outer tube. As compared to steel tubulars of like size, composite tubulars tend to have lower weight, superior burst properties, improved flow coefficients and increased fatigue resistance, while steel tends to exhibit more favorable collapse, compressive and tensile properties. Thus, in certain applications, composite tubulars are a direct alternative to steel while in other applications composites are the highly preferred option.

The physical properties of composite coiled tubing pose challenges and opportunities for the development of new technology to exploit its advantages compared to metal tubulars. One significant property of composite tubing is its markedly different Poisson's ratio compared to steel tubulars. As a result, composite tubing at a given pressure will undergo a contraction in length much greater than the contraction in length of steel tubulars at the same pressure. One problem with coiled composite tubing arises from the exaggerated contraction in length resulting from this difference in Poisson's ratios between composite and steel tubulars. When the composite tubing is spooled onto a tubing reel and pressurized for pumping fluid into the well, the composite tubing contracts and results in very high loading on the tubing reel. This high loading is much more severe than that commonly experienced with steel tubulars, possibly damaging the tubing reel core structure.

Technological advancements in tubular storage reels has been minimal over the past few years. The prior art demonstrates tubing storage reels for steel tubing, e.g., Blount U.S. Pat. No. 5,865,392, and therapeutic gas tubing, e.g., Pierce U.S. Pat. No. 5,826,608, and also demonstrates composite tubing capable of being spooled onto a reel for stowage and use in oil field applications, e.g., Quigley U.S. Pat. No. 5,921,285. However, the prior art fails to demonstrate tubing reels capable of withstanding the high loading resulting from pressurizing coiled composite tubing. The prior art also demonstrates methods for laying rigid pipeline, e.g. Lang U.S. Pat. No. 3,982,402, but fails to demonstrate a method for storing composite tubing in such a manner that does not result in damage to the tubing storage reel.

In order for composite tubing to be commonly accepted by operators for use as production tubing, it is highly desirable to either provide tubing storage reels capable of storing pressurized composite tubulars despite the high loading resulting from the pressure-driven contraction in length of the pressurized composite tubulars, or alternately to provide methods of using existing tubing storage reels with pressurized composite tubing in such a manner as to substantially minimize or prevent damage to tubing storage reels of current design.

The disadvantages of the prior art are overcome by the present invention, and an improved reel for supporting coiled tubing, and particularly composite tubing, is hereinafter disclosed. Also disclosed is a method of winding coiled tubing onto a reel to minimize forces on the tubing reel core when the tubing is substantially pressurized while coiled onto the reel.

SUMMARY OF THE INVENTION

A typical system for a coiled tubing operation involves a rather long length of coiled spoolable tubing, either steel, composite or other material, wound onto a relatively large reel. This invention pertains to the reels commonly used to store or aid installation of such coiled tubing. Typically, the tubing is coiled onto the tubing reel or spool for storage, and then pressurized prior to installation at the worksite. However, as the desire to replace steel coiled tubing with composite coiled tubing has increased within the industry, existing designs for tubing reels or spools have been inadequate in withstanding the radial forces imparted by the composite coiled tubing once pressurized.

The present invention provides apparatus and a method for pressurizing and spooling composite coiled tubing, and affords solutions to the challenges of using composite coiled tubing with existing tubing reel designs. This invention offers advantages over the prior art in that it facilitates and encourages the installation of composite coiled tubing at the worksite by using modified tubing reels without changing the common procedures exercised during installation of the composite coiled tubing down the wellbore.

A compliant material or an assembly of springs and moveable panels located on the exterior surface of the tubing reel core may absorb the radially inward forces exerted by the pressurized coiled composite tubing on the tubing reel core. This allows the existing tubing spooling procedures to be exercised. In the alternative, this invention also offers advantages over the prior art in that it facilitates and encourages the use of composite coiled tubing by using modified coiled tubing spooling procedures without changes to the commonly utilize tubing reel cores for storage and installation of the composite coiled tubing. The modified coiled composite tubing spooling procedure may substantially reduce or eliminate the radially inward forces exerted by the pressurized coiled composite tubing on the tubing reel core, thereby allowing the use of existing tubing reel cores.

A primary objective of this invention is to alleviate or compensate for the radially inward forces exerted by the pressurized coiled composite tubing on the tubing reel core. Three embodiments are disclosed in detail which afford this characteristic. The first embodiment utilizes a specially designed tubing reel core with a compliant material, such as rubber, applied to the spooling surface prior to spooling the coiled tubing. The compliant material provides compliance of the tubing reel core structure. A second embodiment preferably utilizes springs or other biasing members placed between the tubing reel core and the tubing reel spooling surface, and also providing compliance of the tubing reel core structure. The third embodiment utilizes tubing reels of a conventional design, new or existing, or tubing reels of the new designs as disclosed above. This third embodiment pressurizes the coiled composite tubing prior to spooling the tubing onto the tubing reel, and may include releasing the pressure once the tubing is completely spooled.

In the first embodiment, the tubing reel may be comprised of a portable base, a hub rotatable around a hub axis, an end flange at both ends of the hub, and a compliant material on the spooling surface of the hub. The hub preferably has a substantially cylindrical cross-section, but may be other geometric shapes. The compliant material may be rubber, but alternatively may be wood, plastic, glass, carpet, or other woven textiles. The compliant material is preferably placed over a majority of the spooling surface, but alternatively may be applied in less substantial quantities in each of the four quadrants of the reel spooling surface. The compliant material is preferably adhered to the spooling surface with high-grade epoxy, but may be positioned and secured in place by other adhesives, mechanical fasteners, or merely by the interference between the spooled coiled tubing and the tubing reel spooling surface. The compliant material may have a depth between ⅛ inch and 1 inch, and preferably has a radial depth of at least ¼ inch.

As the composite coiled tubing is pressurized, the increase in cross-sectional diameter drives a contraction in the overall tubing length such that the coiled tubing cinches around the hub. The compliant material absorbs the resulting radially inward forces of the pressurized coiled tubing and reduces the forces imparted on the tubing reel structure. This reduces the likelihood of premature damage to the tubing reel and prolongs its useful operating life. In addition, this embodiment is relatively simple in design and operation. The compliant material may be applied in the field using common hand tools and/or an adhesive. This embodiment will not require amended or additional procedures for utilizing the tubing reel for coiled tubing storage or installation, and may be utilized with the commonly used procedures in the industry.

The second embodiment of a composite coiled tubing reel may be comprised of a portable base, a hub rotatable about a hub axis, an end flange at both ends of the hub, and panels or moveable supports fastened to the exterior surface of the hub by compression springs. In this embodiment, the hub may also have a substantially cylindrical shape, but may have other geometric-shaped cross-sections. The panels or moveable supports in this embodiment may be spaced around the hub at constant intervals and may provide a substantially circumferential spooling surface for the coiled tubing to contact, but other embodiments may utilize fewer panels, with at least one panel preferably spaced in each quadrant of the hub. The panels in the preferred embodiment are rectangular shaped, but would have other geometric shapes. The panels may also be covered with the compliant material disclosed in the first embodiment. The springs may be fastened to the exterior hub surface and the interior panel surfaces by mechanical fasteners, but alternatively may be welded or adhered with high-grade epoxy. Other embodiments may include openings in the exterior hub surface to allow the panels and/or springs to partially depress inside the hub exterior surface. Other embodiments may also utilize leaf springs, torsion springs or hydraulic cylinders rather than compression springs to prevent the radial inward forces of the pressurized coiled tubing from damaging the tubing reel hub.

The advantages of the second embodiment are substantially similar to those of the first embodiment. As the coiled tubing is pressurized and the increase in cross-sectional diameter drives a contraction in overall length such that the coiled tubing cinches around the panels, the springs beneath the panels absorb the radially inward forces of the pressurized coiled tubing. As the springs absorb these radially inward forces, they reduce the forces imparted on the tubing reel structure. This reduces the likelihood of premature damage to the tubing reel and prolongs its useful operating life. In addition, this embodiment is relatively simple in design and operation. This embodiment will not require amended or additional procedures for utilizing the tubing reel for coiled tubing storage or installation, and may be utilized with the procedures commonly used today in the industry.

The third embodiment of this invention comprises a method for pressurizing the composite coiled tubing prior to spooling the tubing onto the tubing reel and the subsequent relief of this pressure once the tubing is completely spooled. A preferred embodiment pressurizes the composite coiled tubing to 5000 psi prior to spooling, but other embodiments may pressurize the tubing from as low as 1000 psi up to the maximum rated pressure of the tubing. Other embodiments may not include the subsequent relief of pressure within the spooled tubing.

The advantage of the third embodiment is the substantial reduction in the magnitude of the radially inward forces of the pressurized coiled tubing on the tubing reel. The radially inward forces commonly experienced in the industry are a result of the pressurization of the composite coiled tubing only after the tubing had been spooled onto the reel at ambient pressure. It was this pressurization after spooling the tubing that simultaneously increased the diameter of the composite tubing and decreased its length, thereby cinching the composite tubing around the tubing reel. This embodiment eliminates the forces imparted on the tubing reel as a result of the pressurization of the tubing prior to installation into the wellbore. By spooling the composite tubing onto the tubing reel while the tubing is pressurized and thereafter releasing the pressure, the tubing will initially spool onto the tubing reel, but will not impart high radially inward forces onto the tubing reel. Additionally, once the pressure within the tubing is released, the composite tubing will impart substantially less force onto the tubing reel. This reduces the likelihood of premature damage to the tubing reel and prolongs its useful operating life. In addition, the embodiment is relatively simple in design and operation. This embodiment will not require additional structure, hardware or tools, and the apparatus required to pressurize composite coiled tubing may be the same apparatus currently required and in common use in the industry during coiled tubing stowage and wellbore installation procedures.

It is an object of the present invention to provide an improved reel for supporting coiled tubing thereon, with the reel minimizing or eliminating radially inward compressive forces exerted on the coiled tubing. It is a related object of this invention to provide an improved method of supporting coiled tubing on a portable reel, with the method including winding the coiled tubing on the hub and between end flanges while the coiled tubing is internally pressurized with fluid, and thereafter releasing the fluid pressure on the coiled tubing such that the release of fluid pressure substantially minimizes the radially compressive forces subsequently exerted by the coiled tubing on the hub.

It is a feature of the present invention that the portable reel for supporting coiled may include a compliant material covering at least a portion of an exterior surface of the hub for engagement of the coiled tubing to minimize the radially inward forces. The hub may have substantially cylindrical configuration and the compliant material may be provided on each circumferential quadrant of the substantially cylindrical hub.

It is further feature of this invention that the compliant material may be selected from a wide variety of materials, including rubber, plastic, and wood. As a further feature of the present invention the compliant material may have a radial depth of 1% to 4% of a radial depth between the exterior surface of hub and the radially outermost retaining surface of the end flanges of the coiled tubing. In most embodiments, the compliant material may have a radial depth of from ⅛ inch to 1 inch, and preferably from ¼ inch to ⅞ inch.

It is a further feature of the invention that the portable reel may include a plurality of movable supports each supported on the hub, and a plurality of springs each for biasing a respective one of the plurality of moveable supports radially outward from the hub. Each of the plurality of moveable supports may be an elongate panels extending axially along a substantial portion of an axial spacing between the end flanges, and the plurality of springs may be leaf springs. The hub may also include a plurality of apertures such that each of the plurality of moveable supports may move radially inward with respect to the hub and into a respective one of the plurality of apertures.

It is a feature of the invention that the method of supporting coiled tubing on a reel may include pressurizing the coiled tubing while being wound on the hub and between the end flanges at a pressure an excess of 1000 psi. The fluid pressure exerted on the coiled tubing during this step is preferably is an excess of 60% of the maximum rated pressure of the coiled tubing.

It is an advantage of the present invention that the coiled tubing reel is relatively simply in design and construction, and is highly reliable. A related advantage of the invention is that the coiled tubing reel utilizes conventional components so that it may be reliably used by field personnel who have little experience with coiled tubing reels. It is a further advantage of the method according to the present invention that conventional tubing reels may be utilized to substantially reduce or minimize the radially inward compressive forces on the coiled tubing hub.

These and further objects, features and advantages of the present invention will become apparent from the following detailed description, wherein references made to the figures in the accompanying drawings.

The foregoing and the following disclosure and description of the reel for supporting coiled tubing as well as the disclosed method are illustrative and explanatory thereof. This invention is not intended to be limited to the illustrated and discussed embodiments, as one skilled in the art will appreciate that various changes in the size, shape and materials, as well as in the details of the construction or combination of features of the tubing reel and the disclosed method may be made without departing from the spirit of the invention. Various embodiments exist with alternative methods of spooling the composite coiled tubing without damaging or destroying the tubing reel.

DETAILED DESCRIPTION OF PREFERRED EMBODIMENTS

Figure 1:
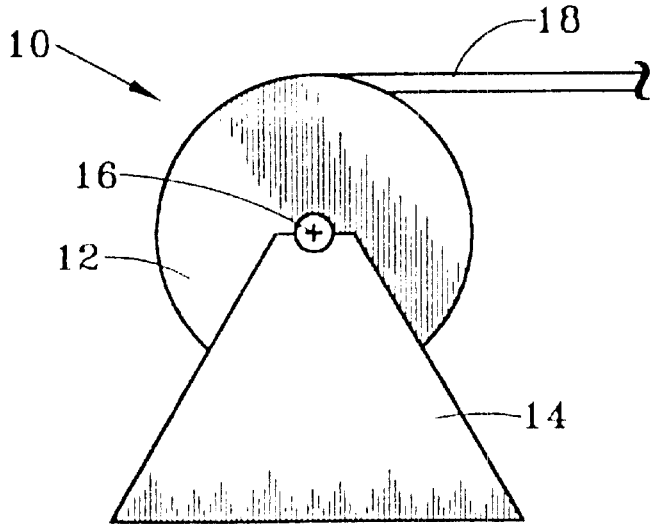
FIG. 1 is a simplified side view of a coiled tubing reel, illustrating composite tubing spooled on the reel.
Figure 2:
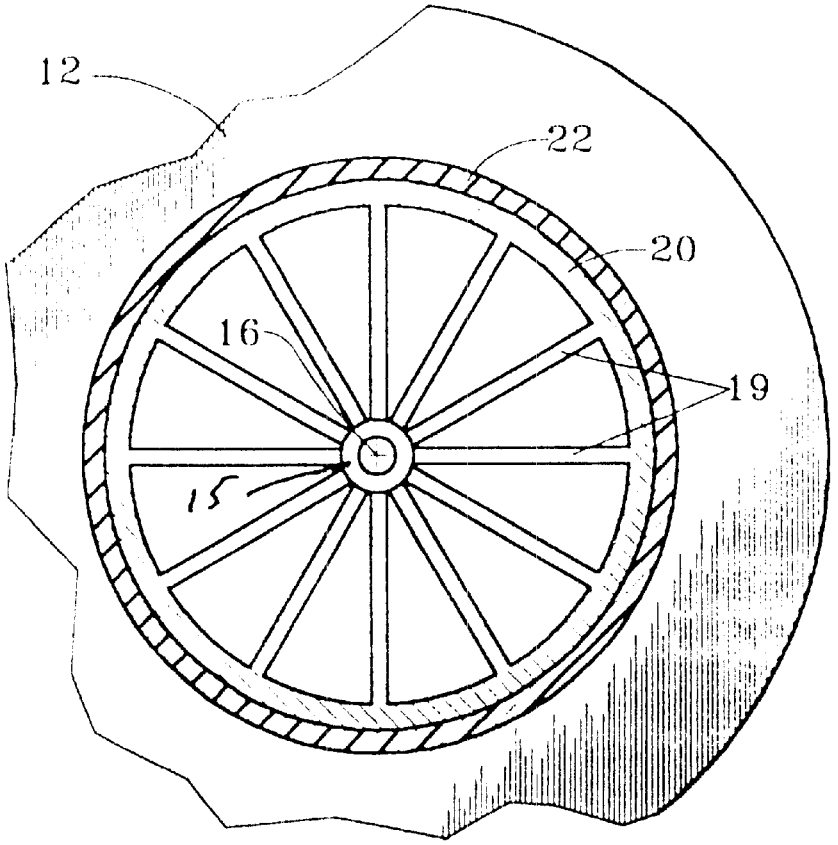
FIG. 2 is a cross-sectional view of a preferred embodiment of the invention, illustrating a compliant material substantially covering the outer surface of a tubing reel hub.

Reference is made to the attached drawings only for the purpose of demonstrating preferred embodiments and not for the purpose of limiting the same. FIG. 1 illustrates generally a reel or spool 10 for supporting and/or transporting composite coiled tubing. The reel 10 is typically transported by truck, barge, or ship, with the entire package of the reel and coiled tubing commonly referred to as a coiled tubing unit. FIG. 1 further illustrates the composite tubing 18 being unreeled and extended from the coiled tubing unit 10 for disposition, as for example, concentrically down a subterranean well for downhole service. FIG. 2 illustrates generally a cross-section of the reel or spool 10 illustrated in FIG. 1 with the composite tubing 18 removed for clarity. In addition, FIG. 2 illustrates components of a preferred embodiment, including the compliant material 22 applied on the exterior surface of the hub 20.

In a preferred embodiment, the outer hub 20 is mounted on a base 14 and rotatable about a hub axis 16. An end flange 12 is adjacent to each axial end of the hub 20 and retains the coiled tubing 18 on the hub 20 and between the flanges 12. A plurality of spokes 19 may be used to interconnect the hub 20 with central shaft 15. A compliant material 22, such as rubber, is applied to the exterior surface of the hub 20. A preferred embodiment consists of the rubber 22 substantially covering the exterior surface of the hub 20, although portions of the exterior surface of the hub 20 may be left uncovered, such that the rubber 22 is minimally applied within each circumferential quadrant of the exterior surface of the hub 20. A preferred embodiment depicts the hub 20 as having a substantially cylindrical shape, but the hub 20 may also take the form of other geometric shapes. The rubber 22 may be fixed to the exterior surface of the hub 20 by a conventional bonding material, such as a high-grade epoxy. Other methods of engagement are also possible, or the rubber 22 may be held in place merely be the interference or friction fit between the coiled tubing 18 and the exterior surface of the hub 20. The material 22 applied to the exterior surface of the hub 20 may be formed from other materials, including but not limited to plastic, wood, carpet or fabric. Other woven textile materials may be used for the compliant material. The rubber 22 applied to the exterior surface of the hub 20 has a radial depth of ¼ inch, but may have a radial depth of either from ⅛ inch to 1 inch, or from 1% to 4% of a radial depth between the exterior surface of the hub 20 and the radially outermost retaining surface of each flange 12. The radial depth of the material 20 is preferably from ¼ inch to ⅞ inch, and commonly is at least ¾ inch thick.

Figure 3:
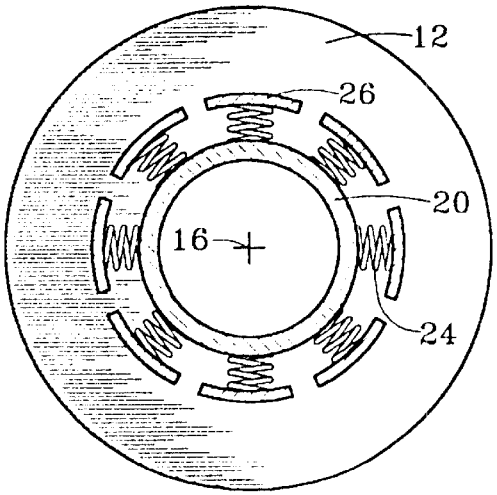
FIG. 3 is a cross-section view of another embodiment of the invention, illustrating a plurality of moveable support and spring assemblies each supported or the tubing reel hub and between the end flanges.
Figure 4:
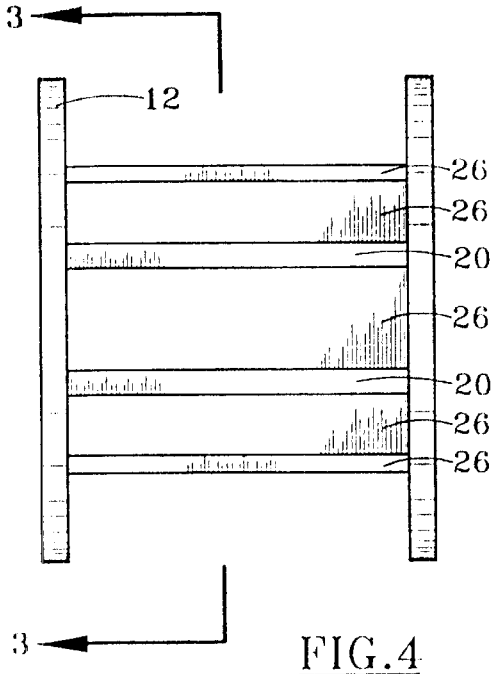
FIG. 4 is a side view of the embodiment shown in FIG. 3.
Figure 5:
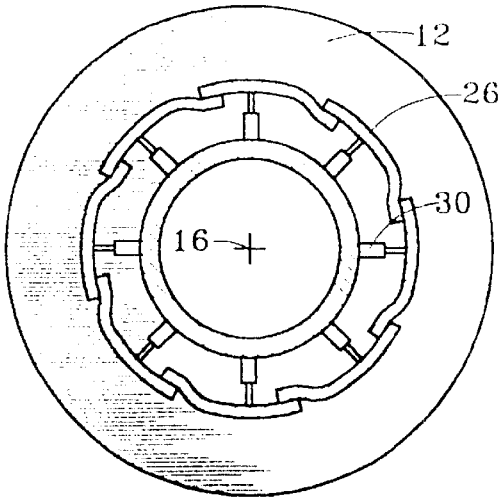
FIG. 5 is a cross-sectional view of another embodiment of the invention.

In another preferred embodiment, the compliant material 22 is replaced with a system of springs and panels. As shown in FIGS. 3 and 4, panels 26 are rectangular in shape, have the same axial length as the hub 20, and are supported by and affixed to the hub 20 by compression springs 24. The panels 26 in the preferred embodiment are circumferentially spaced at constant intervals, and may rest substantially against one another side-by-side at full compression of the springs 24. Other embodiments may incorporate a continuous surface which the tubing 18 contacts by increasing the circumferential dimension of the panels 26, possibly to the extent that they overlap and/or are allowed to slide tangentially with respect to one another. The springs 24 may be attached to the hub 20 and the panels 26 by mechanical fastener, but other methods may be used. Two or more springs 24 may interconnect the hub 20 with each panel 26. Other embodiments may include means other than the compression springs 24 for performing the load biasing function, including but not limited to systems containing hydraulic cylinders, leaf springs, or torsion springs. Various types of biasing members may thus serve the desired purpose. FIG. 5 depicts over lapping panels 26 each biased by a plurality of operatively controlled hydraulic cylinders 30. Other embodiments may incorporate shorter panels 26.

Figure 6:
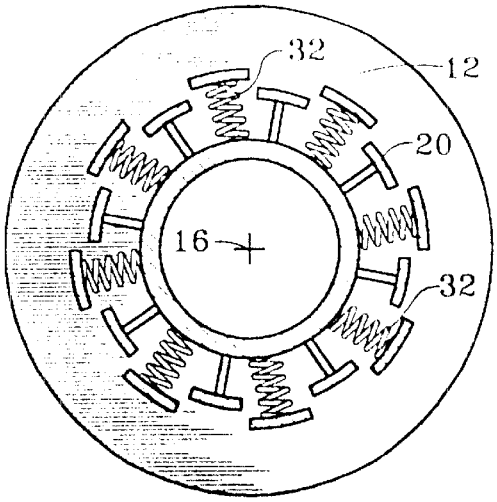
FIG. 6 is a cross-sectional view of yet another embodiment of the invention.

The panels 26 may have geometric shapes other than that of the preferred embodiment, such as circular or oval "buttons," and may be placed at regular or random intervals along the axial direction of the hub 20. As shown in FIG. 6, still other embodiments may include a hub 20 with circumferentially spaced slots or apertures 32 in the exterior surface of the hub 20, such that all or a radially inward portion of the panels 26 may each depress beneath the exterior surface of the hub 20.

A third embodiment includes a process for pressurizing the tubing 18 prior to spooling the tubing 18 onto the coiled tubing reel assembly 10. By pressurizing the tubing 18 to 5000 psi or up to the maximum rated pressure of the tubing 18, subsequently spooling the tubing 18 around the hub 20, and finally relieving the pressure within the tubing 18, the tubing 18 will not contract in length to the extent that current procedures allow, and will thereby reduce or eliminate the radially inward forces of the tubing 18 onto the hub 20. The tubing 18 may be pressurized with fluid in the preferred embodiment. While the preferred embodiment involves pressurizing the tubing 18 to its maximum rated pressure, it may only be pressurized to 60% of the maximum rated pressure, or alternatively may also be pressurized to only 1000 psi. The tubing pressure may be relieved after the tubing 18 has been spooled onto the hub 20.

Still other embodiments may include providing a biasing member on the hub 20, such that the biasing member exerts a radially outward force on the spooled tubing 18. This procedure may be used with the standard coiled tubing reel in common use in the industry, or with the preferred embodiments described above, or a combination thereof. The coiled tubing reel as disclosed herein is a portable reel which, as explained above, is readily transportable. The reel according to this invention alternatively could be stationary, i.e., attached to a movable transport, such as a vessel. The reel also could be fixed in place.

Other embodiments are considered for this invention which may construct any or all of the various components out of a variety of materials, including resinous compounds, other non-metallic compounds, metallic compounds, special alloys, or any combination thereof.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A reel for supporting composite coiled tubing thereon, the coiled tubing being wound onto the reel and pressurized for pumping fluid through the coiled tubing into a subterranean well, the reel comprising:

a portable base;

a hub mounted on the base and rotatable about a hub axis;

an end flange adjacent each axial end of the hub for retaining coiled tubing on the hub and between the end flanges; and a compliant material covering at least a portion of an exterior surface of the hub for engagement with the coiled tubing, such that radially inward compressive forces exerted by the coiled tubing are absorbed by the compliant material.

2. The reel as defined in claim 1, wherein the hub has a substantially cylindrical configuration.

3. The reel as defined in claim 2, wherein the compliant material is provided on the hub and within each circumferential quadrant of the substantially cylindrical hub.

4. The reel as defined in claim 1, wherein the compliant material is positioned along at least a majority of the exterior surface of the hub.

5. The reel as defined in claim 4, wherein the compliant material is positioned along at least substantially 90% of the exterior surface of the hub.

6. The reel as defined in claim 1, wherein the compliant material is selected from a group consisting of rubber, plastic and wood.

7. The reel as defined in claim 1, wherein the compliant material is selected from a group consisting of carpet, fabric or woven textiles.

8. The reel as defined in claim 1, wherein the compliant material has a radial depth of from 1% to 4% of a radial depth between an exterior surface of the hub and the radially outermost retaining surface of each end flange.

9. The reel as defined in claim 1, wherein the compliant material has a radial depth of from ⅛ inch to 1 inch.

10. The reel as defined in claim 9, wherein the compliant material has a radial depth of from ¼ inch to ⅞ inch.

11. A reel for supporting composite coiled tubing thereon, the coiled tubing being wound onto the reel and pressurized internally for pumping fluid through the coiled tubing into a subterranean well, the reel comprising:

a portable base;

a hub mounted on the base and rotated about a hub axis, the hub having a cylindrical configuration;

an end flange adjacent each axial end of the hub for retaining coiled tubing on the hub and between the end flanges; and a compliant material covering at least a portion of the exterior surface of the hub for engagement with the coiled tubing, such that radially inward compressive forces exerted by the coiled tubing are absorbed by the compliant material, the compliant material having a radial depth of from ¼ inch to ⅞ inch.

12. The reel as defined in claim 11, wherein the compliant material is provided on the hub and within each circumferential quadrant of the substantially cylindrical hub.

13. The reel as defined in claim 11, wherein the compliant material is positioned along at least a majority of the exterior surface of the hub.

14. The reel as defined in claim 13, wherein the compliant material is positioned along at least substantially 90% of the exterior surface of the hub.

15. The reel as defined in claim 11, wherein the compliant material is selected from a group consisting of rubber, plastic and wood.

16. The reel as defined in claim 11, wherein the compliant material is selected from a group consisting of carpet, fabric or woven textiles.

17. The reel as defined in claim 11, wherein the compliant material has a radial depth of from 1% to 4% of a radial depth between an exterior surface of the hub and the radially outermost retaining surface of each end flange.

18. A reel for supporting composite coiled tubing thereon, the coiled tubing being wound onto the reel and pressurized for pumping fluid through the coiled tubing and into a subterranean well, the reel comprising:

a portable base;

a hub mounted on the base and rotatable about a hub axis;

an end flange adjacent each axial end of the hub for retaining coiled tubing on the hub and between the end flanges; and a rubber material covering at least a portion of an exterior surface of the hub for engagement with the coiled tubing, such that radially inward compressive forces exerted by the coiled tubing are absorbed by the rubber material, the rubber material having a radial depth of from 1% to 4% of a radial depth between an exterior surface of the hub and the radially outermost retaining surface of each end flange.

19. The reel as defined in claim 18, wherein the compliant material is positioned along at least a majority of the exterior surface of the hub.

20. The reel as defined in claim 19, wherein the compliant material is positioned along at least substantially 90% of the exterior surface of the hub.

21. The reel as defined in claim 18, wherein the rubber material has a radial depth of from ⅛ inch to 1 inch.

* * * * *